US005129449A

United States Patent [19]

Nguyen

[11] Patent Number: 5,129,449

[45] Date of Patent: Jul. 14, 1992

[54] HIGH PERFORMANCE HEAT EXCHANGER

[75] Inventor: Dam C. Nguyen, Rockford, Ill.

[73] Assignee: Sundstrand Corporation, Rockford, Ill.

[21] Appl. No.: 634,028

[22] Filed: Dec. 26, 1990

[51] Int. Cl.[5] ..... F28B 1/02; F28F 3/08

[52] U.S. Cl. ..... 165/110; 165/41; 165/113; 165/165; 165/167; 165/908; 62/506

[58] Field of Search ..... 165/110, 113, 165, 167, 165/908, 41; 62/506

[56] References Cited

U.S. PATENT DOCUMENTS

| | | | |
|---|---|---|---|
| 3,477,504 | 11/1969 | Colyer et al. | 165/165 |
| 3,804,159 | 4/1974 | Searight et al. . | |
| 4,494,171 | 1/1985 | Bland et al. | 165/908 |
| 4,624,305 | 11/1986 | Rojey | 165/165 |
| 4,880,055 | 11/1989 | Niggemann | 165/167 |

*Primary Examiner*—Albert W. Davis, Jr.

*Attorney, Agent, or Firm*—Antonelli, Terry, Stout & Kraus

[57] ABSTRACT

A condenser (44) of a heated fluid which is condensed within a core of the condenser in response to heat exchange between the heated fluid and a coolant fluid flowing through the core in accordance with the invention includes a plurality of heat conductive laminates (70 and 72) having at least one first channel (12) through which the fluid being condensed flows and at least one second channel (14) through which the coolant flows. The cross-sectional area of at least one of the at least one first channel in the condenser decreases in a direction of fluid flow through the condenser producing increased velocity of the heated fluid flowing in the direction of fluid flow causing a shear force between a vapor phase of the heated fluid and liquid phase condensed on a perimeter of at least one first channel which causes the fluid phase to flow through the at least one channel.

20 Claims, 14 Drawing Sheets

HIGH PERFORMANCE HEAT EXCHANGER

TECHNICAL FIELD

The present invention relates to heat exchangers for use in airframes which perform at all attitudes and under variable gravitational force conditions. More particularly, the present invention relates to a heat exchangers for use in a vapor cycle cooling system constructed from laminates having a desuperheater condenser and subcooler.

BACKGROUND ART

Jet impingement heat exchangers are well known which are formed from laminates. For example, see U.S. Pat. No. 4,880,055 and U.S. Pat. No. 4,494,171 which are assigned to the Assignee of the present invention, as well as U.S. patent application Ser. No. 330,071 entitled "Spiral Heat Exchanger", filed on Mar. 29, 1989 and which is assigned to the Assignee of the present invention. Neither of the aforesaid patents or application discloses a heat exchanger containing a desuperheater comprised of a first group of a plurality of heat conductive laminates; a condenser comprised of a second group of a plurality of heat conductive laminates and a subcooler comprised of a third group of a plurality of heat conductive laminates with the first, second and third groups being stacked to form a core with a heated fluid and a coolant fluid each respectively flowing in at least one first channel and at least one second channel through the groups of laminates from one face of the core to another face of the core.

A heat exchanger for use in a vapor cycle cooling system in an airframe which includes a condenser must be lightweight and must function uniformly under all attitudes and gravitational force conditions. Furthermore, a heat exchanger containing a condenser for use in an airframe must have minimal volume. Moreover, in a condenser which is subjected to varying attitudes and gravitational forces, it is necessary to force the condensed liquid through the condenser section which condenses on the periphery of a channel in which the refrigerant is flowing through the condenser. Variation in attitude and gravitational force may cause fluid flow of the condensed refrigerant in a direction opposite to the desired direction or reduce the flow rate thereby diminishing the performance of the condenser and the vapor cycle cooling system in which the condenser is contained.

DISCLOSURE OF INVENTION

The present invention is a high performance heat exchanger having a preferred application in a vapor cycle cooling system in an airframe. The heat exchanger is lightweight, has small volume, provides efficient heat exchange between a heated fluid which preferably is a superheated refrigerant entering the heat exchanger and a coolant fluid flowing through the heat exchanger which condenses and subcools the refrigerant during flow through the heat exchanger core. The heat exchanger operates uniformly under varying attitudes, such as those encountered in an airframe, as well as variable gravitational force conditions caused by the path of flight. With the invention, the cross-sectional area of at least one channel in the condenser through which the refrigerant is flowing is reduced in the direction of fluid flow to increase the velocity of fluid flow through the condenser. The increased velocity creates a shear force between a vapor phase of the heated fluid within at least one channel within the condenser and a liquid phase of the heated fluid condensing on a periphery of the at least one channel to force the liquified fluid through the condenser to increase its performance. The additional velocity provided by the decrease in cross-sectional area of the at least one channel through which the heated fluid to be condensed is flowing produces a desired flow rate through the condenser which provides high performance as well as enhancing the condensing of the vapor phase at the interface between the liquid phase and the vapor phase at which the shear force is created.

A heat exchanger containing a heated fluid which is condensed within a core of the heat exchanger in response to heat exchange between the heated fluid and a coolant fluid flowing through the core in accordance with the invention includes a desuperheater comprised of a first group of a plurality of heat conductive laminates forming at least one first channel through which heated fluid flows and at least one second channel through which the coolant fluid flows for changing the heated fluid within the at least one first channel from a superheated vapor into a saturated vapor; a condenser comprised of a second group of a plurality of heat conductive laminates forming the at least one first channel and the at least one second channel for changing the saturated vapor within the at least one first channel into saturated liquid; and a subcooler comprised of a third group of a plurality of heat conductive laminates forming the at least one first channel and the at least one second channel for changing the saturated liquid within the at least one first channel into subcooled liquid; and wherein the first, second and third groups are joined together in a stack to form the core with heated fluid and coolant fluid each respectively flowing in the at least one first channel and in the at least one second channel through the groups of laminates from one face of the core to another face of the core.

The desuperheater is comprised of first and second heat conductive laminates, the at least one first channel of the desuperheater having at least one aperture in at least one first laminate having a perimeter defining in part each of the at least one first channel through which the heated fluid flows into contact with a plurality of apertures in at least one first channel within a plurality of second laminates with the at least one aperture in the at least one first laminate and the plurality of apertures in the plurality of second laminates forming jets of fluid which impinge upon a heat conductive surface of another laminate. The at least one second channel of the desuperheater having at least one aperture in at least one first laminate having a perimeter defining in part each of the at least one second channel through which the coolant fluid flows into contact with a plurality of apertures in the at least one second channel within a plurality of second laminates with the at least one aperture of the at least one second channel in the at least one first laminate and the plurality of apertures in the plurality of second laminates forming jets of fluid which impinge upon a heat conductive surface of another laminate.

The condenser is comprised of first and second heat conductive laminates, the at least one first channel of the condenser having at least one aperture in a plurality of first laminates with each aperture having a perimeter defining in part each of the at least one first channel through which the heated fluid flows and at least one aperture in a plurality of second laminates with each aperture of the second laminate having a perimeter defining in part each of the at least one first channel with apertures of the first and second laminates of the condenser being in fluid communication to define at least a part of a fluid path of the heated fluid through the condenser. The cross-sectional area of at least one of the at least one first channel in the condenser decreases in a direction of fluid flow through the condenser producing increasing velocity of the heated fluid flowing in the direction of fluid flow causing a shear force between a vapor phase of the heated fluid and a liquid phase condensed on the perimeter of the at least one first channel. The at least one first channel flows through the condenser in first and second directions which are opposite to each other. A change in direction of the at least one first channel from the first direction to a second direction or the second direction to the first direction is produced by an obstruction which stops fluid flow of the heated fluid in the at least one first channel past the obstruction. The at least one second channel of the condenser has at least one aperture in the at least one first laminate having a perimeter defining in part each of the at least one second channel through which the coolant fluid flows into contact with a plurality of apertures in the at least one second channel within a plurality of the second laminates with the at least one aperture of the at least one second channel in the at least one first laminate and the plurality of apertures in the plurality of second laminates forming jets of fluid which impinge upon a heat conductive surface of another laminate.

A condenser of a heated fluid which is condensed within a core of the condenser in response to heat exchange between the heated fluid and a coolant fluid flowing through the core in accordance with the invention includes a plurality of heat conductive laminates forming at least one first channel through which the heated fluid being condensed flows and at least one second channel through which the coolant fluid flows; and wherein a cross-sectional area of at least one of the at least one first channel in the condenser decreases in a direction of fluid flow through the condenser for producing increased velocity of the heated fluid flowing in the direction of fluid flow causing shear force between a vapor phase of the heated fluid and a liquid phase condensed on a perimeter of at least one first channel which causes the liquid phase to flow through the at least one channel. The condenser is comprised of first and second heat conductive laminates, the at least one first channel of the condenser having at least one aperture in a plurality of first laminates with each aperture having a perimeter defining in part each of the at least one first channel through which the heated fluid flows and at least one aperture in a plurality of second laminates with each aperture of the second laminate having a perimeter defining in part each of the at least one first channel with apertures of the first and second laminates of the condenser being in fluid communication to define at least a part of a fluid path of the heated fluid through the condenser; and the at least one second channel of the condenser has at least one aperture in the at least one first laminate having a perimeter defining in part each of the at least one second channel through which the coolant fluid flows into contact with a plurality of apertures in the at least one second channel within a plurality of the second laminates with the at least one aperture of the at least one second channel in the at least one first laminate and the plurality of apertures and the plurality of second laminates forming jets of fluid which impinge upon a heat conductive surface of another laminate. One of width or length of a perimeter defining the cross-sectional area is reduced along a fluid flow path of at least one of the at least one first channel. The at least one first channel flows through the condenser in a first direction and a second direction opposite the first direction with one of the width or length of the perimeter being different for fluid flow in the first direction and fluid flow in the second direction.

BEST MODE FOR CARRYING OUT THE INVENTION

The present invention is a lightweight, high efficiency, small volume heat exchanger which operates stably under all attitudes and variation in gravitational force applied to the heat exchanger such as changes in attitude and gravitational force produced by changes in direction of an airframe which carries the heat exchanger. The heat exchanger in accordance with the invention is formed from first, second and third groups of heat conductive laminates which respectively form a desuperheater, condenser, and subcooler with the first, second and third groups being joined together in a stack to form a heat exchanger core with heated fluid and coolant fluid each respectfully flowing into at least one first channel and at least one second channel through the groups of laminates from one face of the core to another face of the core.

Figure 1:
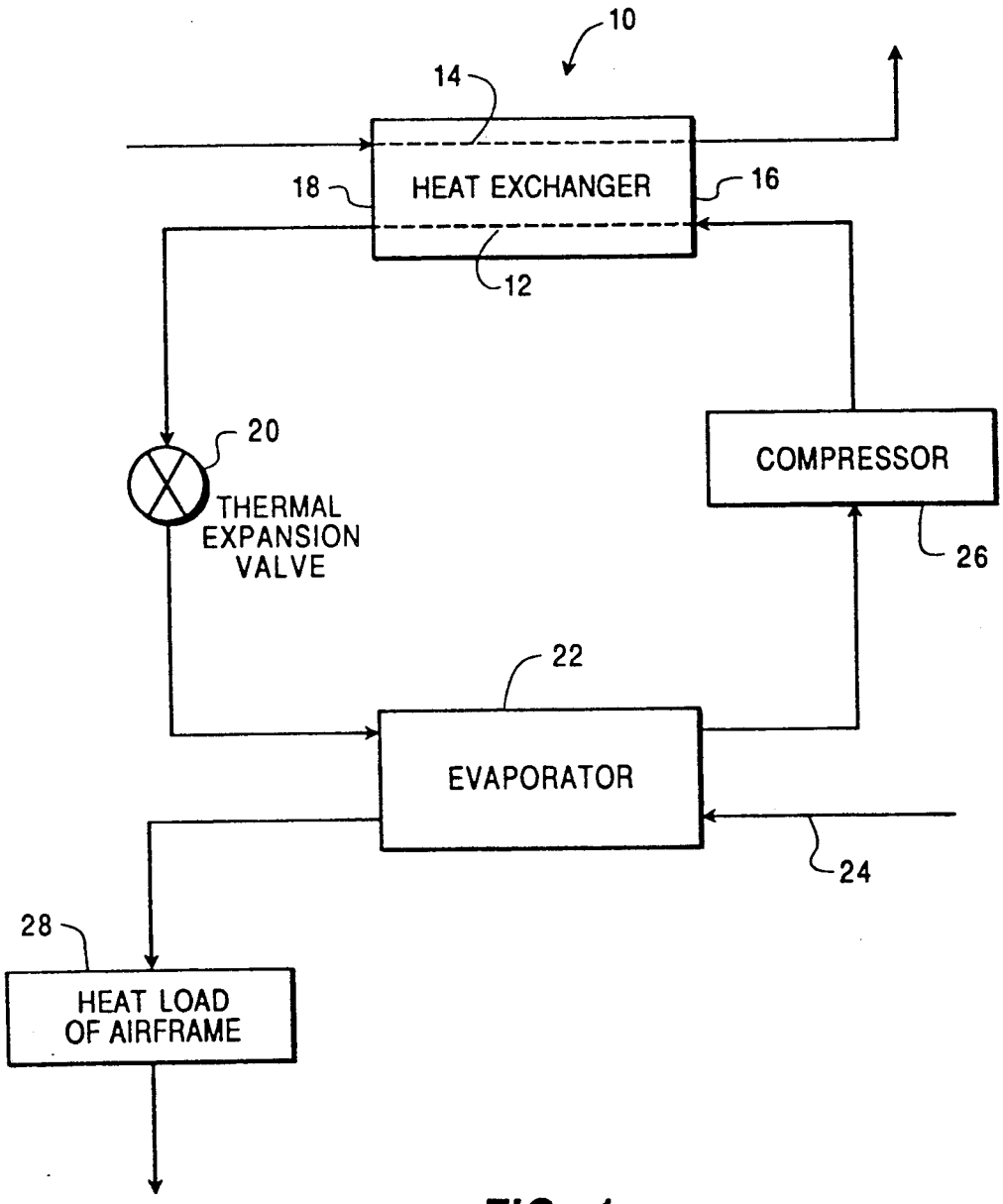
FIG. 1 illustrates a vapor cycle cooling system in an airframe utilizing a heat exchanger in accordance with the present invention.

FIG. 1 illustrates an application of a heat exchanger 10 in accordance with the present invention. While the preferred embodiment of the present invention is in a vapor cycle cooling system, it should be understood that the present invention is not limited thereto. Like parts are identified by identical reference numerals throughout the drawings. In its preferred form, the heat exchanger 10 has at least one first channel 12 through which a heated fluid flows and at least one second channel 14 which is flowing in a direction leaving the heat exchanger which is opposite the direction that the heated fluid leaves the heat exchanger. The counterflow of heated fluid and coolant enhances the transfer of heat with the heat exchanger core as described below in conjunction with FIGS. 2-14. The heat exchanger 10 preferably contains three sections described below which are a desuperheater comprised of the first group of a plurality of heat conductive laminates forming at least one first channel through which the heated fluid flows and at least one second channel through which the coolant fluid flows for changing the heated fluid within the at least one first channel from a superheated vapor into a saturated vapor, a condenser comprised of the second group of a plurality of heat conductive laminates forming the at least one first channel in the at least one second channel for changing the saturated vapor within the at least one first channel into saturated liquid; and a subcooler comprised of the third group of a plurality of heat conductive laminates forming the at least one first channel and the at least one second channel for changing the saturated liquid within the at least one first channel into subcooled liquid. As described below in conjunction with FIG. 2, the first, second and third groups form the core with the heated fluid and coolant fluid each respectfully flowing in the at least one first channel 12 and the at least one second channel 14 through the groups of laminates from or to a face 16 and from or to a face 18. The supercooled refrigerant flows to a thermal expansion valve 20 which expands the supercooled liquid. Evaporator 22 cools a heat bearing fluid 24 which flows in a counterflow direction with respect to the direction of flow of the expanded refrigerant through the evaporator 22. The expanded refrigerant flows to compressor 26 where it is pressurized and flows to the entrance of the heat exchanger 10. The heat bearing fluid 24 is cooled which flows to a heat load 28 of an airframe which may be, but is not limited to the electronics or the cabin of the airframe.

Figure 2:
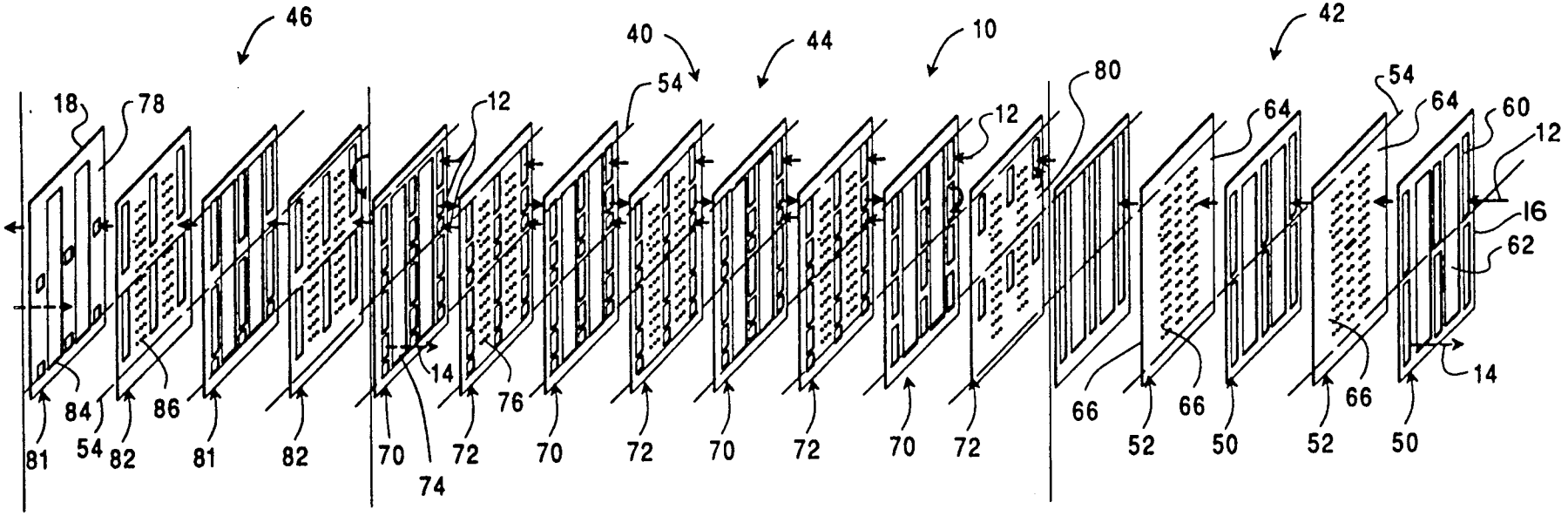
FIG. 2 illustrates an exploded view of a heat exchanger in accordance with the present invention.

FIG. 2 illustrates an exploded view of a heat exchanger 10 in accordance with the present invention. The heat exchanger core comprises a desuperheater 42, a condenser 44 and a subcooler 46. The desuperheater 42 changes superheated vapor entering face 16 into saturated vapor at the time of discharge into the condenser 44. The condenser 44 changes saturated vapor entering the condenser into saturated liquid at the time of discharge. The supercooler changes saturated liquid within the at least one first channel into subcooled liquid which is discharged from face 18.

The desuperheater 42 is preferably comprised of first and second alternating laminates 50 and 52. However, it should be understood that the desuperheater 42 may contain additional laminates different from the laminates 50 and 52. Centerlines 54 divide the laminates of the desuperheater, condenser and supercooler into upper and lower halves. Fluid flow of the heated fluid is illustrated in only the upper half of each of the laminates herein, but it should be understood that fluid flow is identical in the lower half. Each first plate 50 is comprised of a plurality of apertures 60 having a perimeter defining in part each of the at least one first channel 12 flowing through the heat exchanger core within the desuperheater. Each first laminate 50 also has at least one aperture 62 having a perimeter defining in part each of the at least one second channel through which the coolant fluid flows. The heated fluid 12 flows through each of the apertures 60 and impinges upon a plurality of apertures 64 which are aligned with each first aperture 60 to produce jets of fluid which flow from the apertures through the next successive aperture 60 into contact with the heat conductive surface of the next second laminate 52. The heated fluid then flows from the point of impact with the laminate 52 through the apertures 64 with the number of first and second laminates 50 and 52 being variable depending upon the temperature drop which is required to convert the superheated vapor into saturated vapor. Similarly, the coolant 14, which flows in a direction opposite to the heated fluid 12, flows through an aperture 62 into contact with apertures 66 which form jets of fluid which flow through a subsequent aperture 62 and impinge upon a subsequent second laminate 52 and then flow through the apertures 66 to form jets of fluid. The flow of fluid in the at least one first channel 12 and the at least one second channel 14 in opposite directions through the desuperheater 42 functions as a jet impingement heat exchanger which sinks heat from the heated fluid 12 into the coolant 14 in a highly efficient manner with a lightweight and small volume core as a consequence of the jet impingement cooling.

The condenser 44 is comprised of a plurality of third and fourth plates 70 and 72. The at least one second channel 14 flows through third and fourth laminates 70 and 72 to form jet impingement cooling in the manner described above with respect to the desuperheater 42. The at least one second channel 14 of the condenser is formed by at least one aperture 74 in at least one first laminate having a perimeter defining in part each of the at least one second channel through which the coolant fluid flows into contact with a plurality of apertures 76 in the at least one second channel within a plurality of second laminates with the at least one aperture 74 of the at least one second channel in the at least one first laminate and the plurality of apertures 76 in the plurality of second laminates forming jets of fluid which impinge upon a heat conductive surface of another laminate in the manner described above with respect to the first and second channels of the desuperheater 12.

On the other hand, the heated fluid within the at least one channel 12 flowing through the condenser 44 changes direction at least twice as a consequence of impinging upon obstructions 78 and 80 which are respectively located within the laminates of the subcooler and the laminates of the condenser.

An important aspect of the design of the condenser 44 of the present invention is that a cross-sectional area of at least one first channel 12 in the condenser decreases in a direction of fluid flow through the condenser providing increased velocity of the heated fluid flowing in the direction of fluid flow causing a shear force between a vapor phase of the heated fluid and a liquid phase condensed on a perimeter of the at least one first channel which causes the liquid phase to flow through the at least one first channel. The decrease in cross-sectional area may either be continual by reducing the cross-sectional area of each successive laminate 70 and 72 or by making a decrease after several laminates have the same cross-sectional area. It is important to provide the liquid phase of the heated fluid within the at least one first channel during fluid flow through the condenser with sufficient velocity to counteract the effects of attitude change or gravitational force caused by a change in direction such as that which occurs in an airframe to provide efficient heat exchanger operation. Furthermore, the production of shear between the liquid and vapor phase promotes the transfer of heat from the heated vapor phase to the condensed liquid on an outside perimeter of the at least one first heated fluid channel 12 through the conductive laminates to the at least one second coolant channel comprising the condenser 44 to achieve high efficiency heat exchange. One of the width or length of a perimeter defining the cross-sectional area of the at least one first channel 12 is reduced along a fluid flow path of at least one of the at least one first channel to cause an increase in velocity. A reduction of the height of the perimeter of the cross-sectional area of the at least one channel 12 with each change in direction is discussed below with respect to FIG. 4.

The subcooler 46 is comprised of fifth and sixth laminates 80 and 82 which provide jet impingement cooling for the at least one second channel 14 flowing through the subcooler 46 from entry at face 18. The at least one second channel 14 of the subcooler 46 is formed in part by at least one aperture 84 in at least one fifth laminate 81 having a perimeter defining a part of each of the at least one second channel 14 through which the coolant flows into contact with a plurality of apertures 86 in the at least one second channel within a plurality of sixth laminates 82 with the at least one aperture of the at least one second channel in the at least one fifth laminate and the plurality of apertures in the plurality of sixth laminates forming jets of fluid which impinge upon a heat conductive surface of another laminate.

Figure 3:
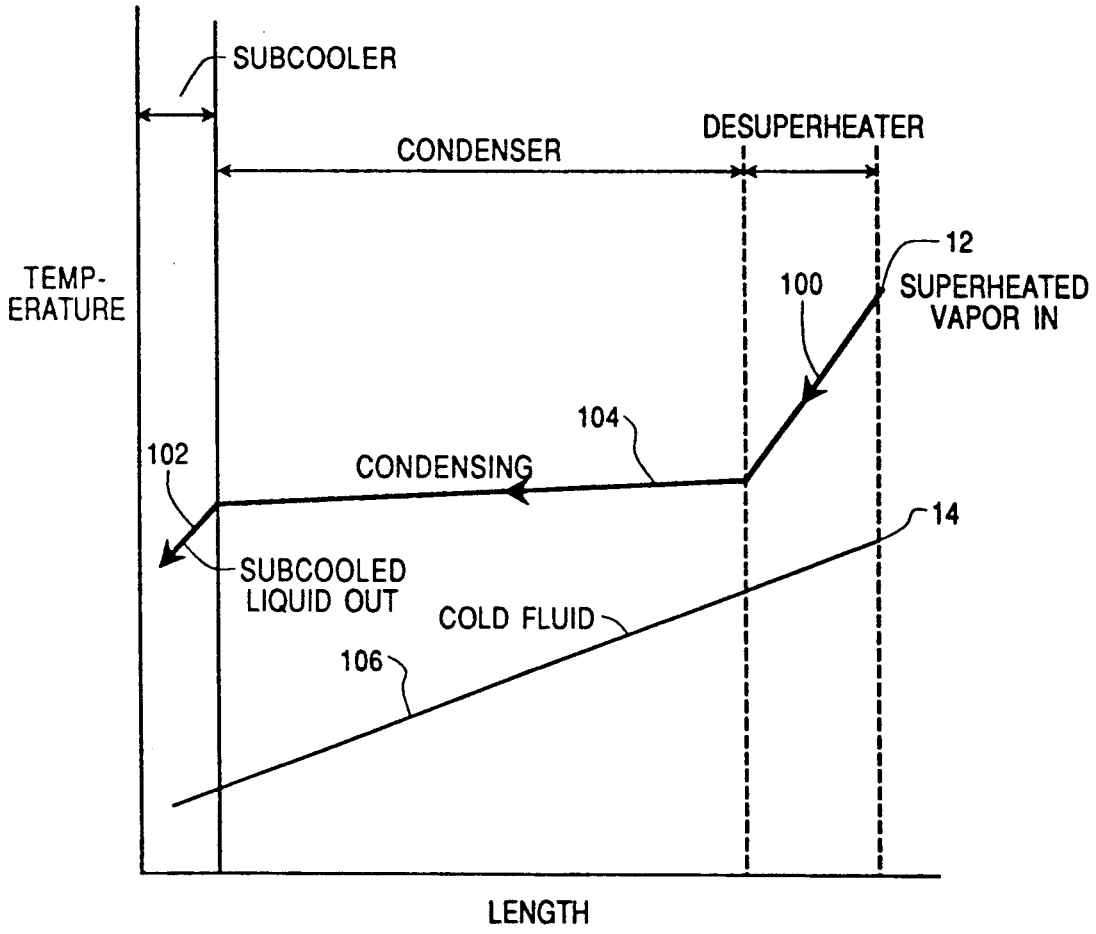
FIG. 3 illustrates the temperature performance of a heat exchanger in accordance with the present invention as a function of length.

FIG. 3 illustrates the temperature of the heat exchanger 10 as a function of length for fluid flow through the heat exchanger core. The rapid drop in temperature of the heated fluid 12 in the desuperheater 42 is indicated by the steep decreasing temperature as a function of length slope 100 in the desuperheater. The combination of the two jet impingement cooling mechanisms in the at least one first channel 12 and the at least one second channel 14 promotes high efficiency heat exchange with minimal length and volume. The relative small drop in temperature as a function of length slope 104 of the heated fluid in the condenser is caused by the inherent function of a condenser in which the heat of condensation maintains a relatively constant temperature. The decreasing cross-sectional surface area as a function of length in the condenser increases the velocity of the liquid and vapor phase of the heated fluid flowing through the condenser 44 to promote efficient condensing as a result of rapidly moving the condensed liquid through the core and the turbulence between the liquid and vapor phases. The single jet impingement cooling mechanism within the at least one second channel 14 and the at least one first channel 12 produces a rapid drop in temperature of the heated fluid as a function of length slope 102 as indicated in the subcooler region. For purposes of comparison, it should be noted that the temperature of the heated fluid drops the most rapidly in section 100 of the desuperheater, drops with an intermediate slope 102 within the subcooler 46 and drops with the smallest slope 104 in the condenser 44. The differences in slope are caused by the differences in the heat exchanger structure of the at least one first channel 12 and the at least one second channel 14. The coolant fluid has a constant slope 106 as a function of length as a result of jet impingement cooling being used throughout the passage of the at least one channel 14 through the heat exchanger 10 from face 18 to face 16.

Figure 4:
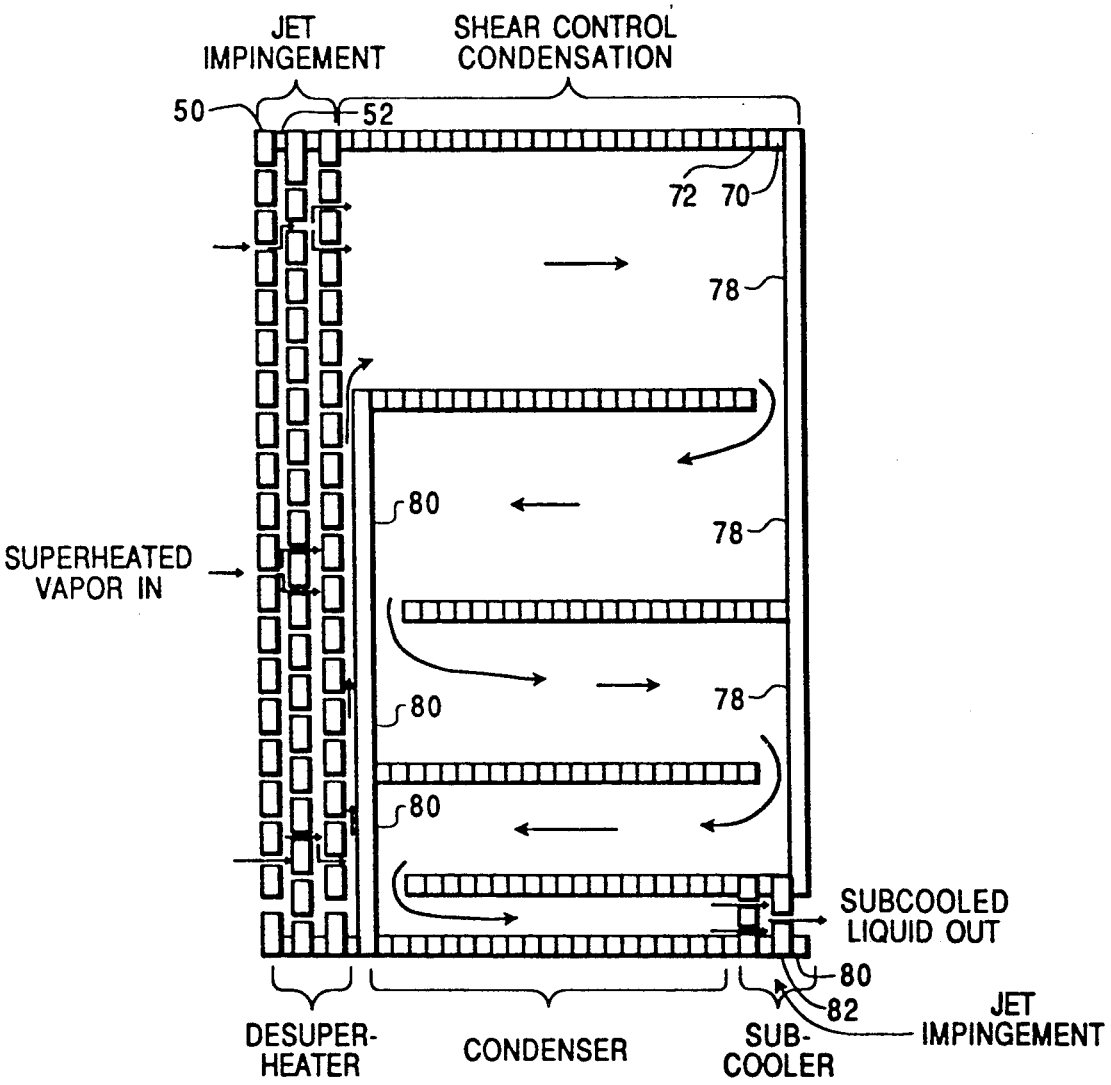
FIG. 4 illustrates the flow path of the heated fluid through a heat exchanger core in accordance with the present invention.

FIG. 4 illustrates a diagram of the fluid flow of the at least one first channel 12 through the core of the heat exchanger 10. As is apparent, the height of the apertures is reduced for each change in direction of the fluid flow through the heat exchanger core caused by obstructions 78 or 80. This reduction in height produces the increase in velocity which causes the liquid phase of the heated fluid within the condenser 44 to be accelerated through the condenser to promote high efficiency heat exchange even under conditions of varying attitude or varying gravitational force caused by change in direction.

Figure 5:
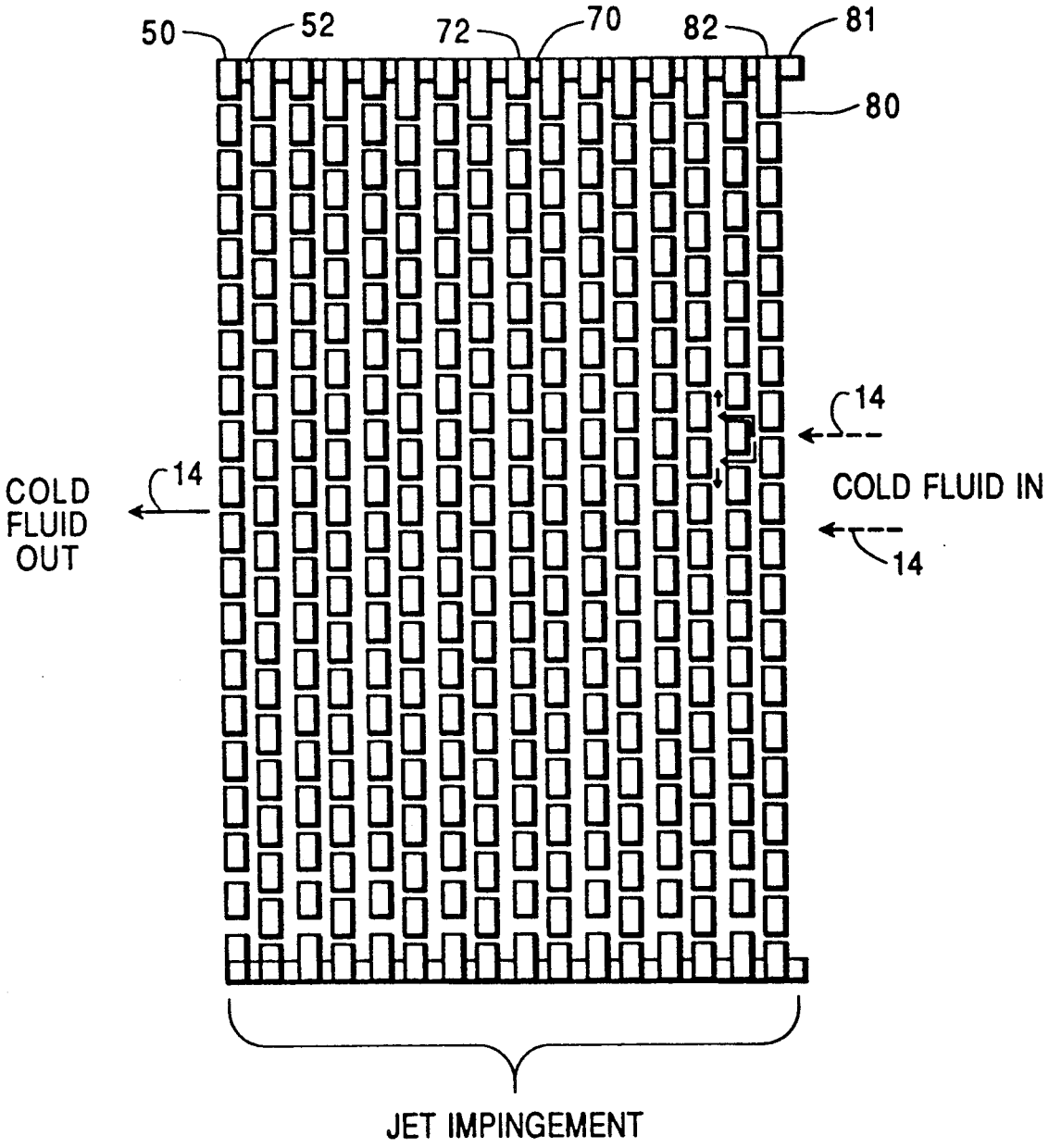
FIG. 5 illustrates the flow path of the coolant fluid through a heat exchanger in accordance with the present invention.

FIG. 5 illustrates a block diagram of the jet impingement flow of the cold fluid through the core of the heat exchanger 10. It should be understood that the number of laminates in FIG. 5 differs from that illustrated in FIG. 2 with the invention being subject to being practiced with varying number of laminates in each of the desuperheater 42, condenser 44 and subcooler 46.

Figure 6:
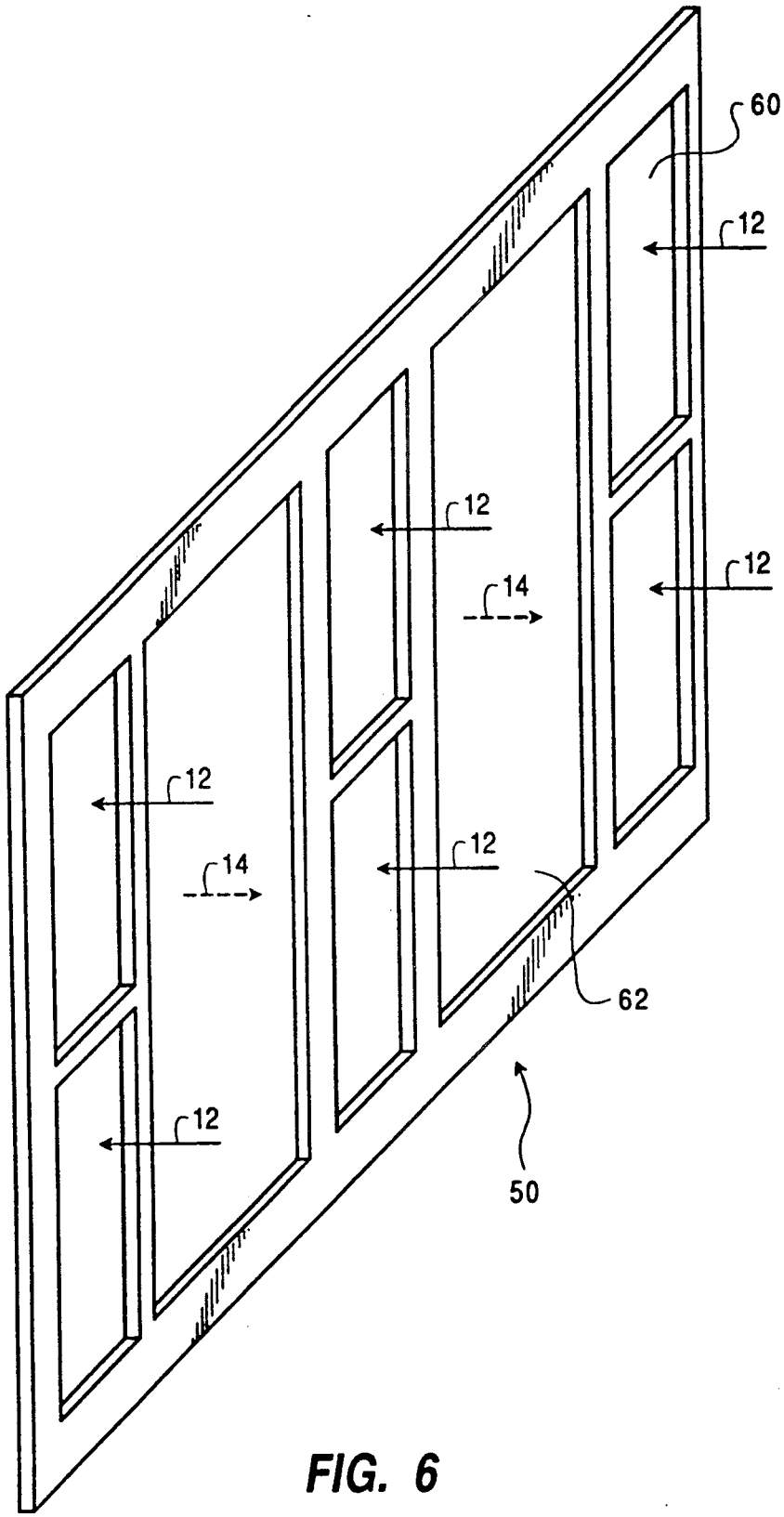
FIGS. 6 and 7 illustrate laminations for implementing the desuperheater of the heat exchanger of the present invention.

FIG. 6 illustrates an expanded first laminate 50 of the type illustrated in FIG. 2.

Figure 7:
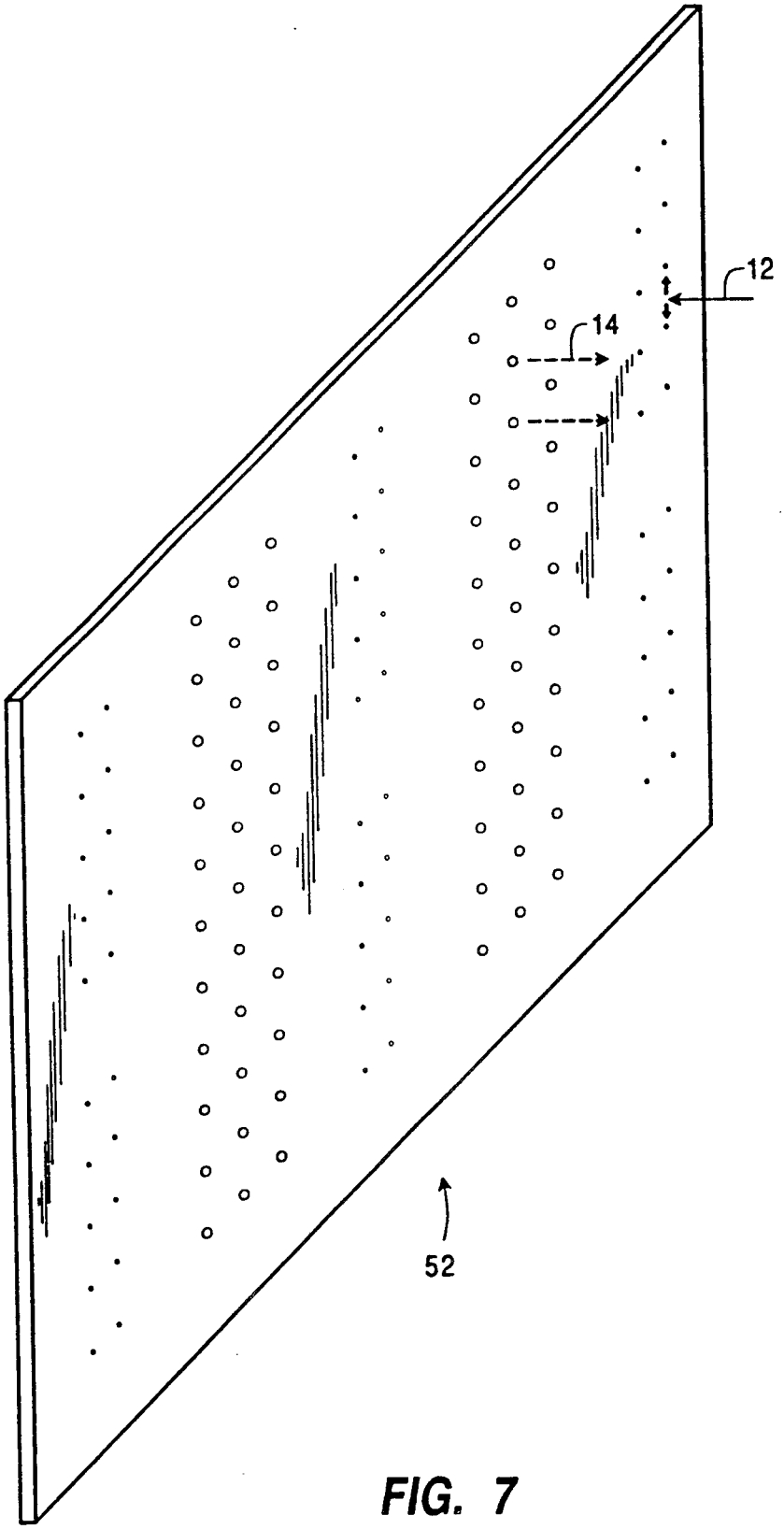

FIG. 7 illustrates an expanded second laminate 52 with impingement of fluid in at least one of the first channels 12 being illustrated as impinging upon a heat conductive surface of the laminate.

Figure 8:
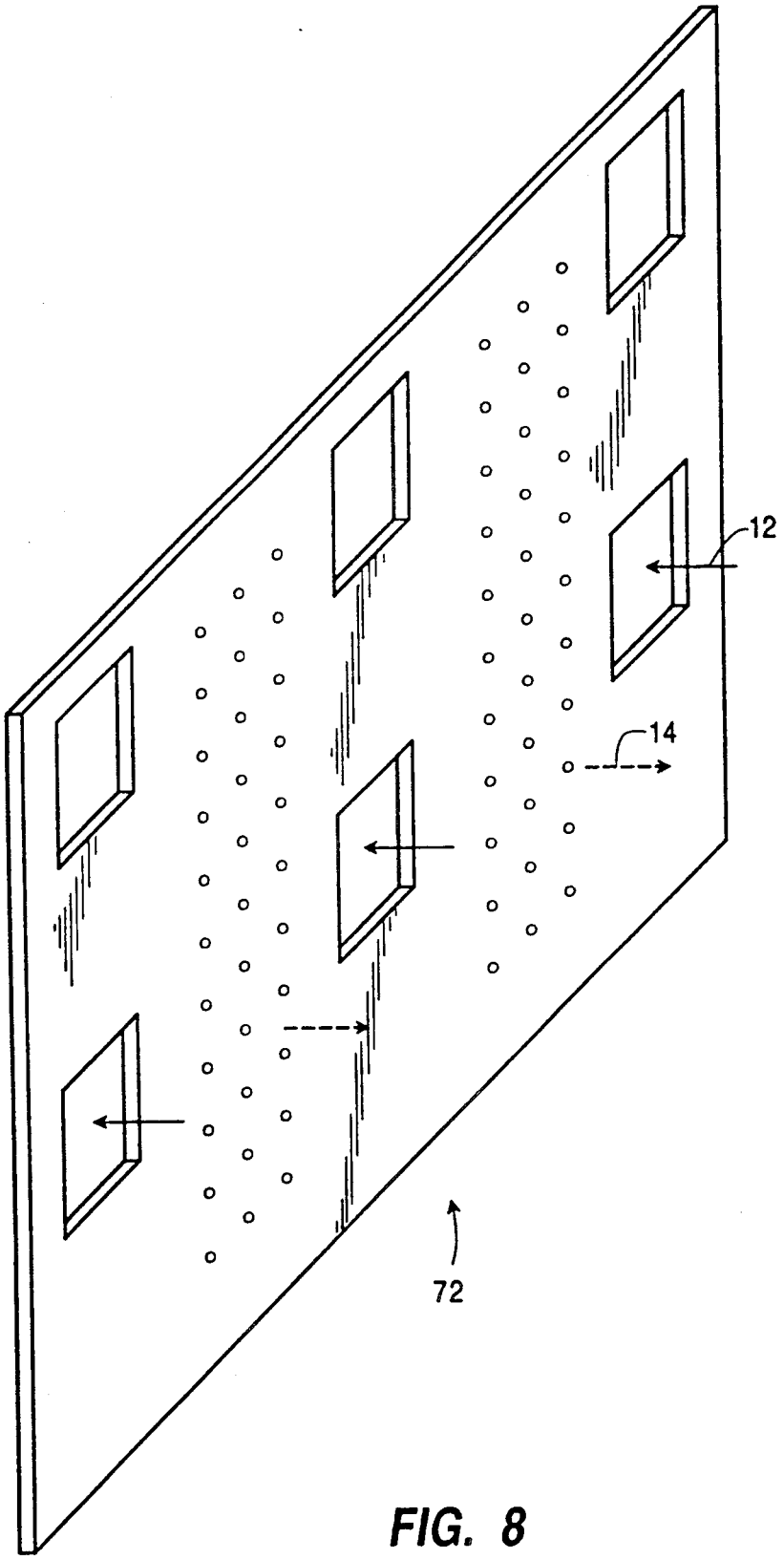
FIGS. 8–11 illustrate the laminations for implementing the condenser of the heat exchanger of the present invention.

FIG. 8 illustrates an expanded fourth laminate 72 of the type illustrated in FIG. 2.

Figure 9:
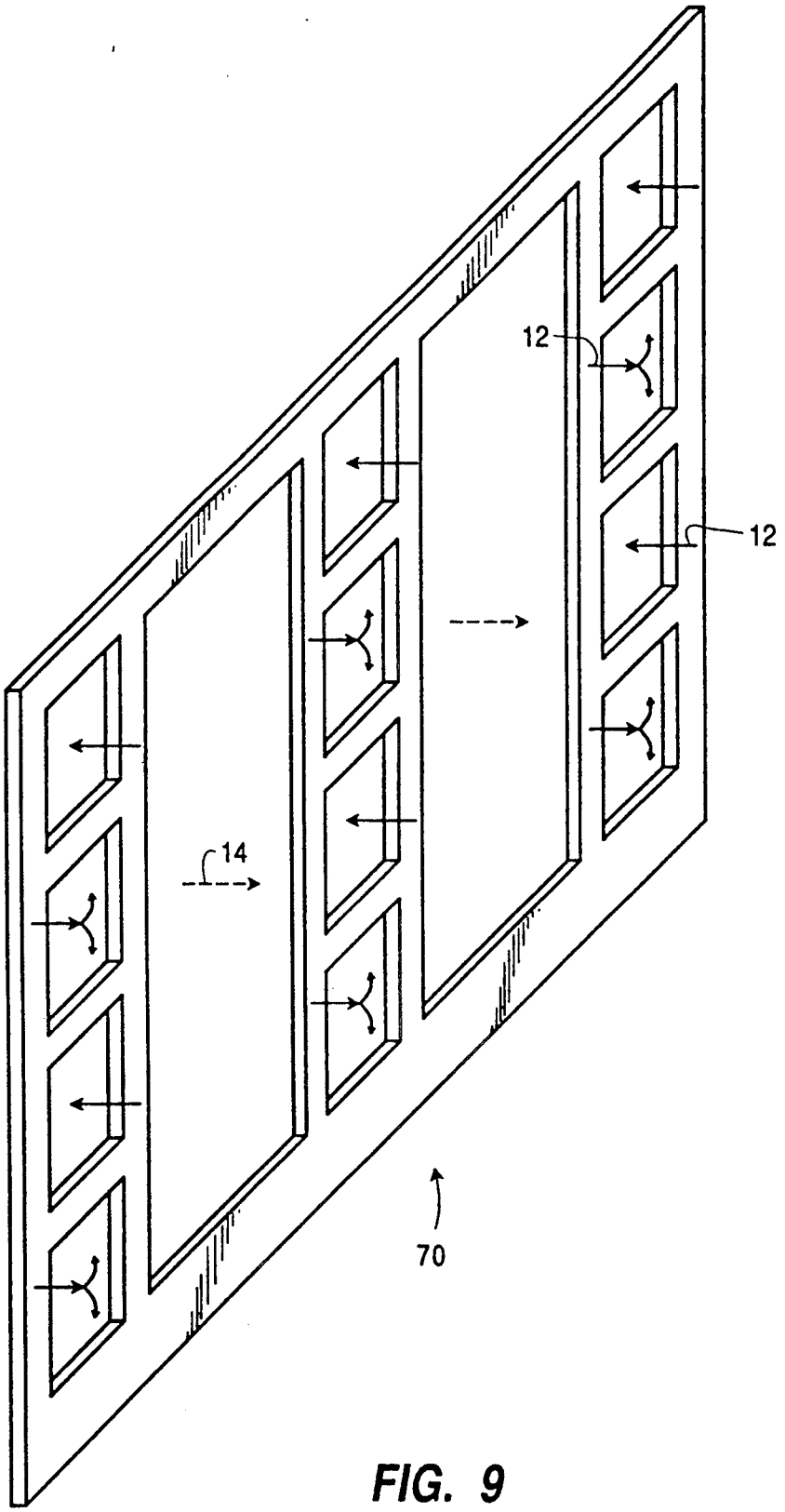

FIG. 9 illustrates an expanded third laminate 70 of the type disposed at an end of the condenser 44 facing the desuperheater 42 as illustrated in FIG. 2. The change in direction caused by obstruction 80 is illustrated by curved arrows branching from the at least one first channel 12.

Figure 10:
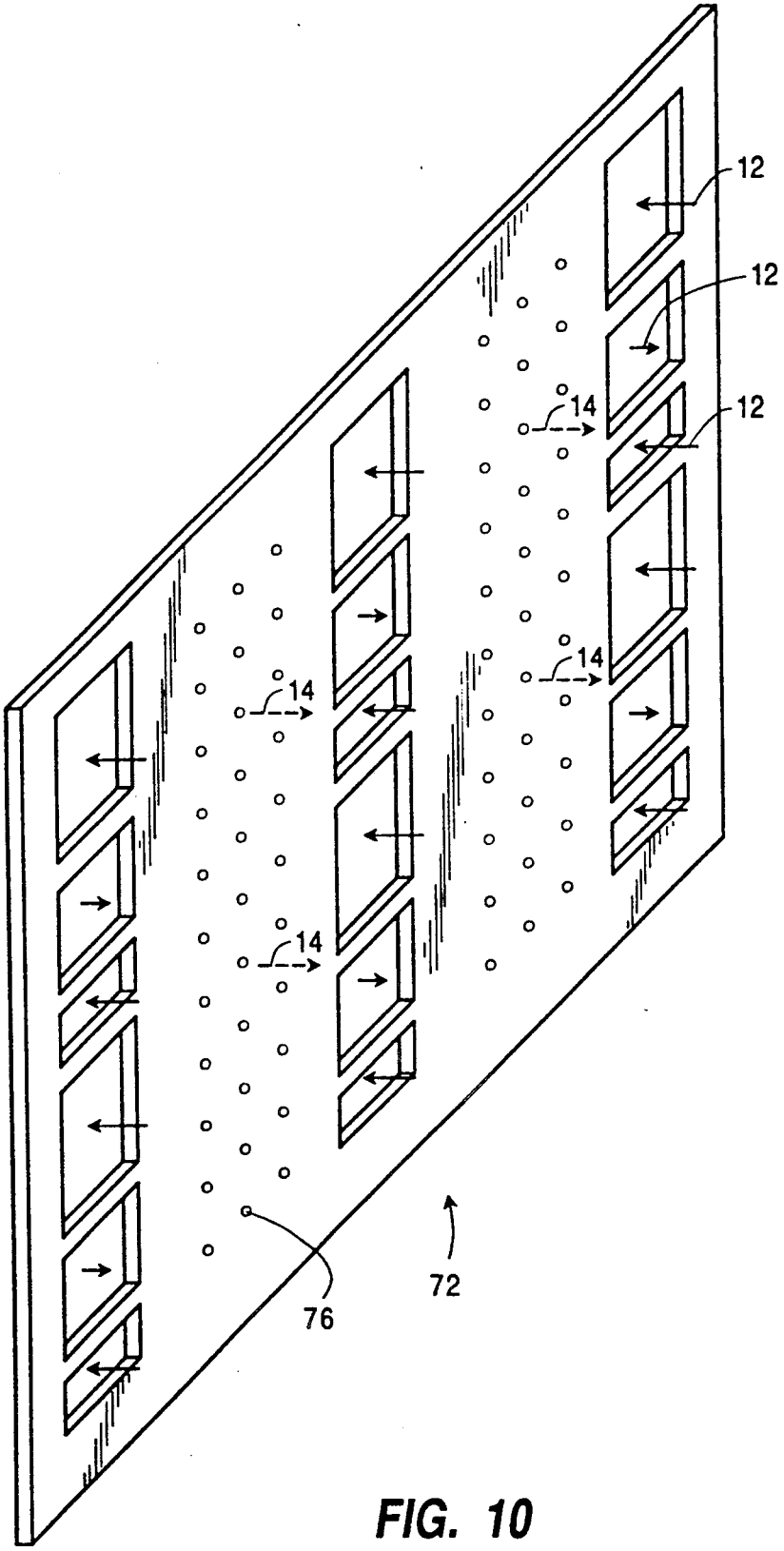

FIG. 10 illustrates an expanded view of another fourth laminate 72 within the condenser 44. The reduction in height occurring at reversals in the direction of the at least one channel 12 caused by obstructions 78 and 80 within the condenser is illustrated.

Figure 11:
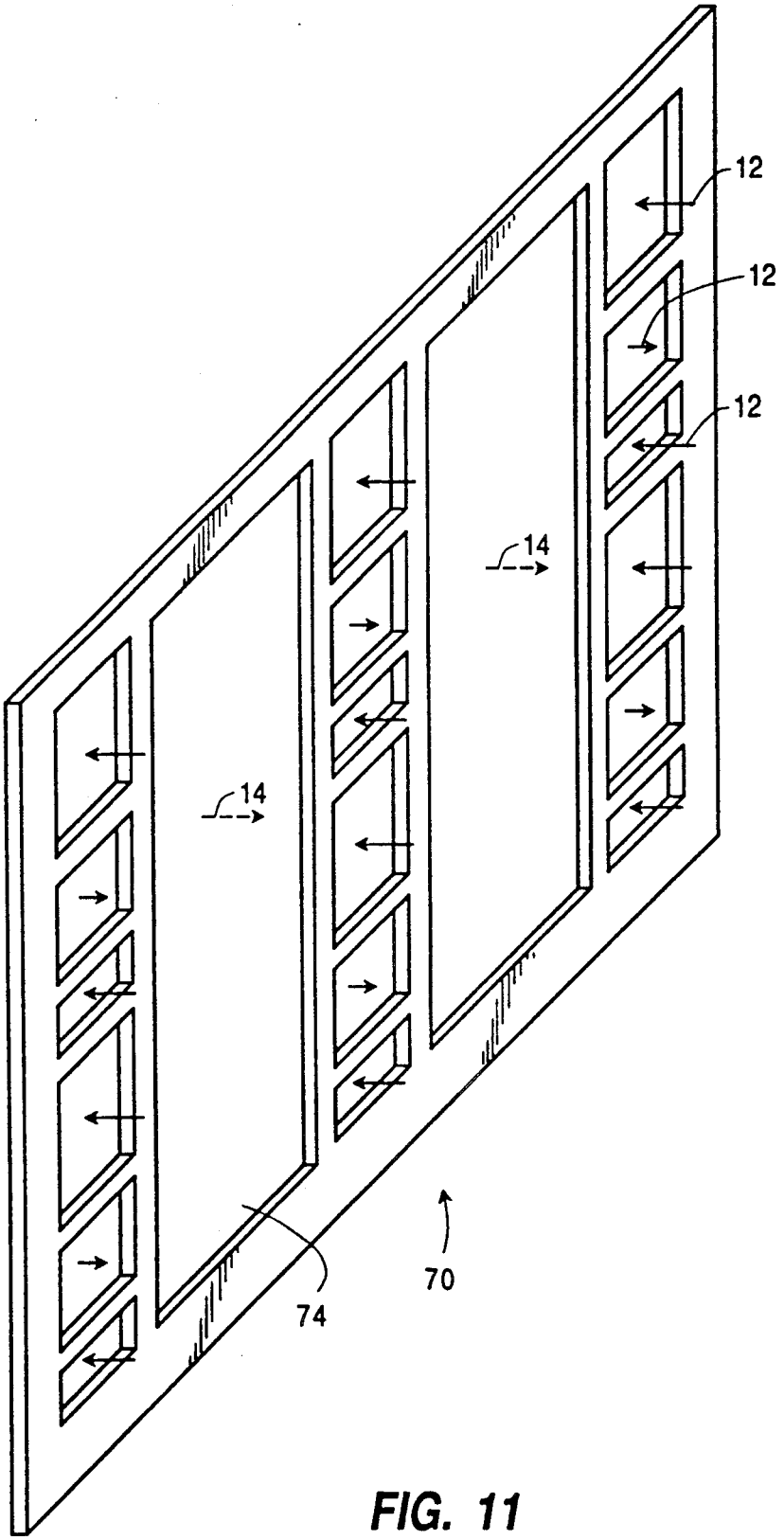

FIG. 11 illustrates an expanded view of a third laminate 70 disposed at an end of the condenser 44 facing the subcooler 46.

Figure 12:
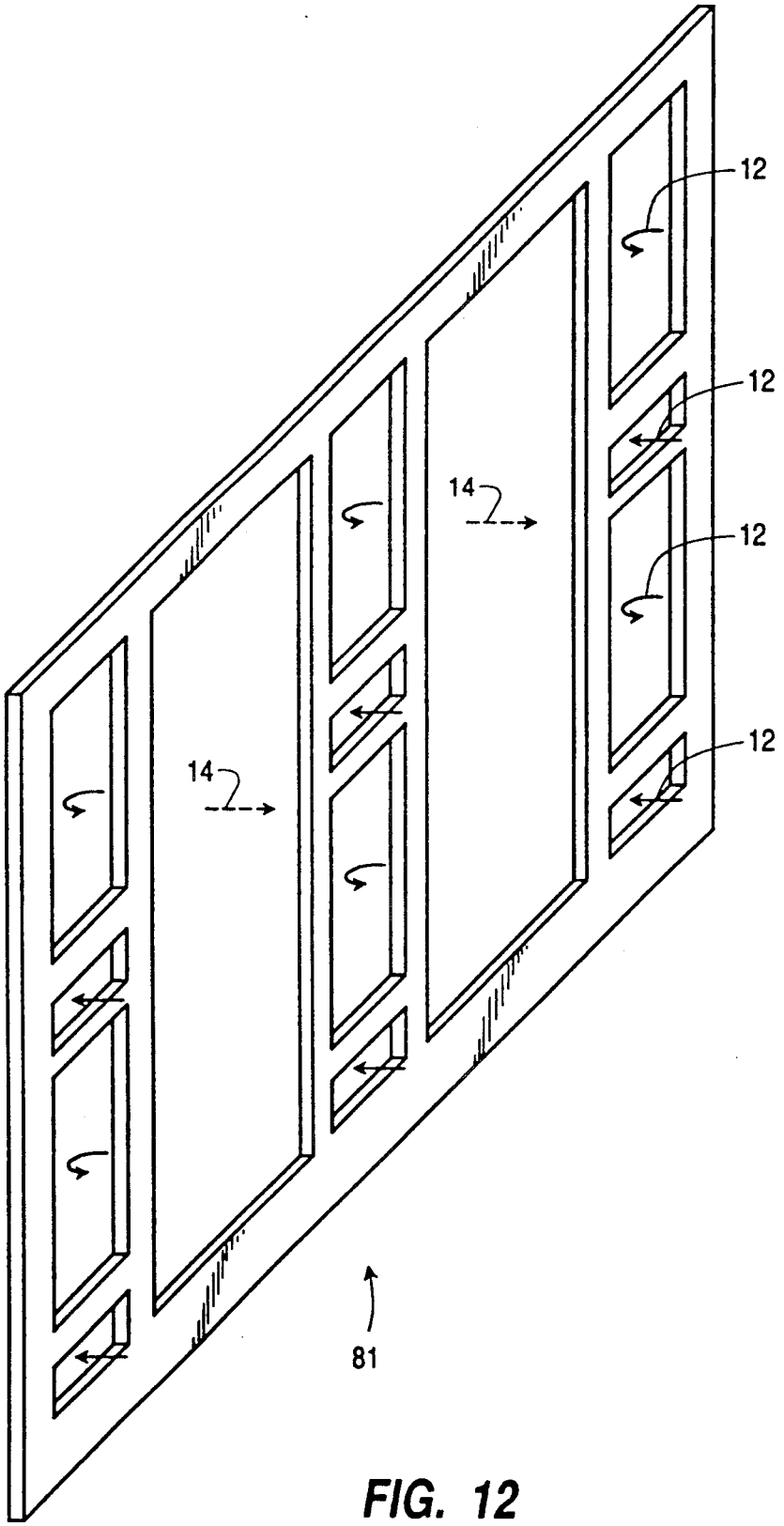
FIGS. 12–14 illustrate the laminations for implementing the subcooler of a heat exchanger in accordance with the present invention.

FIG. 12 illustrates an expanded view of a fifth laminate 81 within the interior of the subcooler 46.

Figure 13:
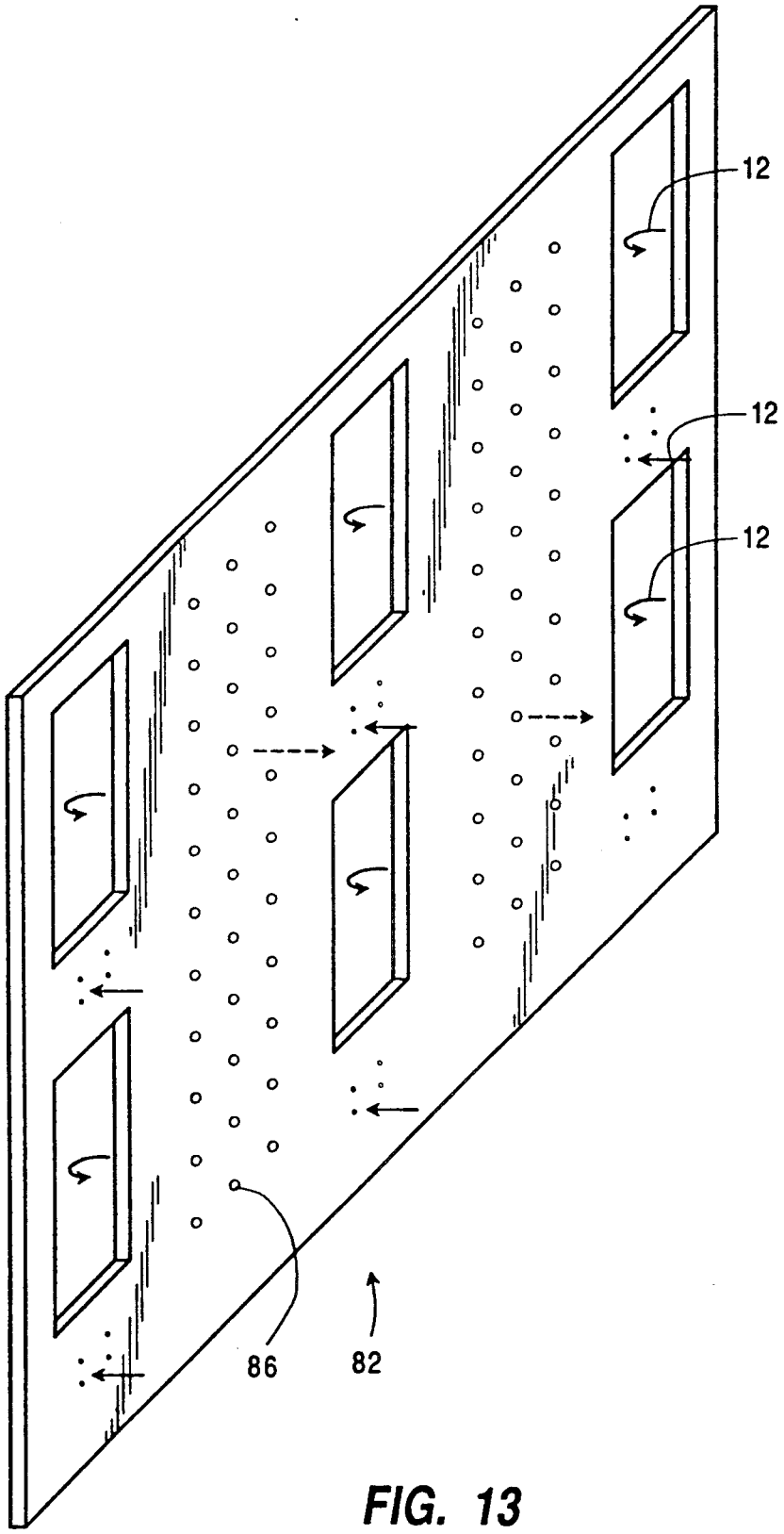

FIG. 13 illustrates an expanded view of a sixth plate 82 within the interior of the subcooler 46.

Figure 14:
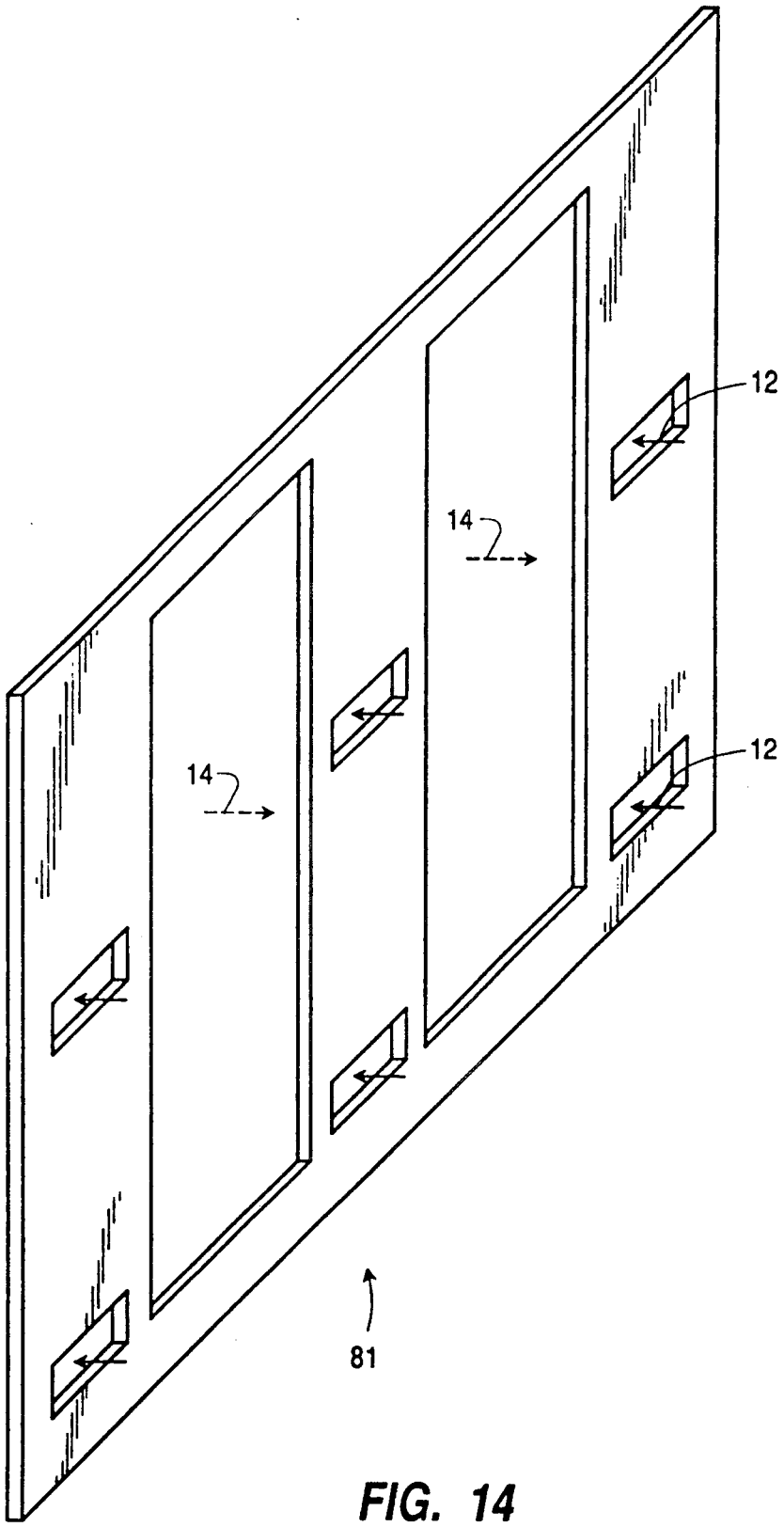

FIG. 14 illustrates an expanded view of a fifth plate 81 disposed on the outside of the subcooler 46 which receives the at least one channel 14.

The heat exchanger 10 of the present invention is formed by a plurality of stacked laminates 50, 52, 70, 72, 81 and 82. These laminates are joined by brazing, diffusion, bonding or any method which assures the prevention of substantial leakage between the heated fluid flowing in the at least one channel 12 and the coolant fluid flowing in the at least one channel 14. Furthermore, the present invention is not limited to utilizing the laminates illustrated in FIG. 2. Laminates which provide spacing or other types of heat exchange structures may be utilized in combination with the laminates as illustrated.

Moreover, while the invention is particularly suited for applications in an airframe in which changes in attitude and direction create substantial forces on liquid flowing through the heat exchanger core which interfere with thermal efficiency. It should be understood that the invention may be used in diverse fields of application. It is intended that all such modifications fall within the scope of the appended claims.

I claim:

1. A heat exchanger containing a heated fluid which is condensed within a core of the heat exchanger in response to heat exchange between the heated fluid and a coolant fluid flowing through the core comprising:

a desuperheater comprised of a first group of a plurality of heat conductive laminates forming at least one first channel through which the heated fluid flows and at least one second channel through the coolant fluid flows for changing the heated fluid within the at least one first channel from a superheated vapor into a saturated vapor;

a condenser comprised of a second group of a plurality of heat conductive laminates forming the at least one first channel and the at least one second channel for changing the saturated vapor within the at least one first channel into saturated liquid; and a subcooler comprised of a third group of a plurality of heat conductive laminates forming the at least one first channel and the at least one second channel for changing the saturated liquid within the at least one first channel into subcooled liquid; and wherein the first, second and third groups are joined together in a stack to form the core with heated fluid and coolant fluid each respectively flowing in the at least one first channel and the at least one second channel through the groups of laminates from one face of the core to another face of the core.

2. A heat exchanger in accordance with claim wherein:

the desuperheater is comprised of first and second heat conductive laminates, the at least one first channel of the desuperheater having at least one aperture in at least one first laminate having a perimeter defining in part each of the at least one first channel through which the heated fluid flows into contact with a plurality of apertures in the at least one first channel within a plurality of second laminates with the at least one aperture in the at least one first laminate and the plurality of apertures in the plurality of second laminates forming jets of fluid which impinge upon a heat conductive surface of another laminate.

3. A heat exchanger in accordance with claim 2 wherein:

the at least one second channel of the superheater has at least one aperture in at least one first laminate having a perimeter defining in part each of the at least one second channel through which the coolant fluid flows into contact with a plurality of apertures in the at least one second channel within a plurality of second laminates with the at least one aperture of the at least one second channel in the at least one first laminate and the plurality of apertures in the plurality of second laminates forming jets of fluid which impinge upon a heat conductive surface of another laminate.

4. A heat exchanger in accordance with claim wherein:

the condenser is comprised of first and second heat conductive laminates, the at least one first channel of the condenser having at least one aperture in a plurality of first laminates with each aperture having a perimeter defining a part of each of the at least one first channel through which the heated fluid flows and at least one aperture in a plurality of second laminates with each aperture of the second laminate having a perimeter defining a part of the at least one first channel with the apertures of the first and second laminates of the condenser being in fluid communication to define at least a part of fluid path of the heated fluid through the condenser.

5. A heat exchanger in accordance with claim 4 wherein:

a cross-sectional area of at least one of the at least one first channel in the condenser decreases in a direction of fluid flow through the condenser producing increased velocity of the heated fluid flowing in the direction of fluid flow causing a shear force between a vapor phase of the heated fluid and a liquid phase condensed on a perimeter of the at least one first channel which causes the liquid phase to flow through the at least one first channel.

6. A heat exchanger in accordance with claim 5 wherein:

the at least one first channel flows through the condenser in first and second directions which are opposite to each other.

7. A heat exchanger in accordance with claim 6 wherein:

a change in direction of the at least one first channel from the first direction to a second direction or from the second direction to the first direction is produced by an obstruction which stops fluid flow of the heated fluid in the at least one first channel past the obstruction.

8. A heat exchanger in accordance with claim 5 wherein:

the at least one second channel of the condenser has at least one aperture in the at least one first laminate having a perimeter defining in part each of the at least one second channel through which the coolant fluid flows into contact with a plurality of apertures in the at least one second channel within a plurality of the second laminates with the at least one aperture of the at least one second channel in the at least one first laminate and the plurality of apertures in the plurality of second laminates forming jets of fluid which impinge upon a heat conductive surface of another laminate.

9. A heat exchanger in accordance with claim 6 wherein:

the at least one second channel of the condenser has at least one aperture in the at least one first laminate having a perimeter defining in part each of the at least one second channel through which the coolant fluid flows into contact with a plurality of apertures in the at least one second channel within a plurality of the second laminates with the at least one aperture of the at least one second channel in the at least one first laminate and the plurality of apertures in the plurality of second laminates forming jets of fluid which impinge upon a heat conductive surface of another laminate.

10. A heat exchanger in accordance with claim 7 wherein:

the at least one second channel of the condenser has at least one aperture in the at least one first laminate having a perimeter defining in part each of the at least one second channel through which the coolant fluid flows into contact with a plurality of apertures in the at least one second channel within a plurality of the second laminates with the at least one aperture of the at least one second channel in the at least one first laminate and the plurality of apertures in the plurality of second laminates forming jets of fluid which impinge upon a heat conductive surface of another laminate.

11. A heat exchanger in accordance with claim 4 wherein:

the at least one second channel of the condenser has at least one aperture in the at least one first laminate having a perimeter defining in part each of the at least one second channel through which the coolant fluid flows into contact with a plurality of apertures in the at least one second channel within a plurality of the second laminates with the at least one aperture of the at least one second channel in the at least one first laminate and the plurality of apertures in the plurality of second laminates forming jets of fluid which impinge upon a heat conductive surface of another laminate.

12. A heat exchanger in accordance with claim 4 wherein:

a cross-sectional area of at least one of the at least one channel in the condenser decreases in a direction of fluid flow through the condenser.

13. A heat exchanger in accordance with claim 12 wherein:

the at least one first channel flows through the condenser in first and second directions which are opposite to each other.

14. A heat exchanger in accordance with claim 13 wherein:

a change in direction of the at least one first channel from the first direction to a second direction or the second direction to the first direction is produced by an obstruction within a laminate which stops fluid flow of the heated fluid in the at least one first channel past the obstruction.

15. A heat exchanger in accordance with claim 14 wherein:

a change in direction of fluid flow in the condenser in the at least one first channel from toward the subcooler to away from the subcooler is produced by an obstruction within one of the fifth or sixth laminates aligned with the at least one first channel; and a change in direction of fluid flow in the condenser from toward the desuperheater in the at least one first channel in the condenser to away from the desuperheater is produced by an obstruction within one of the third or fourth laminates aligned with the at least one first channel.

16. A heat exchanger in accordance with claim wherein:

the subcooler is comprised of first and second heat conductive laminates, the at least one first channel of the subcooler has at least one aperture in a plurality of first laminates with each aperture having a perimeter defining a part of each of the at least one first channel through which the heated fluid flows and at least one aperture in a plurality of second laminates with each aperture of the second laminate having a perimeter defining a part of the at least one first channel with apertures of the first and second laminates of the subcooler being in fluid communication to define at least a part of the fluid path of the heated fluid through the subcooler.

17. A heat exchanger in accordance with claim 16 wherein:

the at least one second channel of the subcooler is formed in part by at least one aperture in at least one first laminate having a perimeter defining a part of each of the at least one second channel through which the coolant flows into contact with a plurality of apertures in the at least one second channel within a plurality of second laminates with the at least one aperture of the at least one second channel in the at least one first laminate and the plurality of apertures in the plurality of second laminates forming jets of fluid which impinge upon a heat conductive surface of another laminate.

18. A heat exchanger in accordance with claim 1 wherein:

the desuperheater is comprised of first and second heat conductive laminates, the at least one first channel of the desuperheater has at least one aperture in at least one first laminate having a perimeter defining in part each of the at least one first channel through which the heated fluid flows into contact with a plurality of apertures in at least one first channel within a plurality of second laminates with the at least one aperture in the at least one first laminate and the plurality of apertures in the plurality of second laminates forming jets of fluid which impinge upon a heat conductive surface of another laminate;

the condenser is comprised of third and fourth heat conductive laminates, the at least one first channel of the condenser has at least one aperture in a plurality of laminates with each aperture having a perimeter defining a part of each of the at least one first channel through which the heated fluid flows and at least one aperture in a plurality of fourth laminates with each aperture of the fourth laminate having a perimeter defining a part of each of the at least one first channel with the apertures of the third and fourth laminates of the condenser being in fluid communication to define at least a part of a fluid path of the heated fluid through the condenser; and the subcooler is comprised of fifth and sixth heat conductive laminates, the at least one first channel of the subcooler having at least one aperture in a plurality of fifth laminates with each aperture having a perimeter defining a part of each of the at least one first channel through which the heated fluid flows and at least one aperture in a plurality of sixth laminates with each aperture of the sixth laminate having a perimeter defining a part of the at least one first channel with the apertures of the fifth and sixth laminates of the subcooler being in fluid communication to define at least a part of a fluid path of the heated fluid through the subcooler.

19. A heat exchanger in accordance with claim 18 wherein:

the at least one second channel of the desuperheater has at least one aperture in at least one first laminate having a perimeter defining in part each of the at least one second channel through which the coolant fluid flows into contact with a plurality of apertures in the at least one second channel within a plurality of second laminates with the at least one aperture of the at least one second channel in the at least one first laminate and the plurality of apertures in the plurality of second laminates forming jets of fluid which impinge upon a heat conductive surface of another laminate;

the at least one second channel of the condenser has at least one aperture in the at least one third laminate having a perimeter defining in part each of the at least one second channel through which the coolant fluid flows into contact with a plurality of apertures in the at least one second channel within a plurality of the fourth laminates with the at least one aperture of the at least one second channel in the at least one third laminate and the plurality of apertures in the plurality of fourth laminates forming jets of fluid which impinge upon a heat conductive surface of another laminate; and the at least one channel of the subcooler has at least one aperture in at least one fifth laminate having a perimeter defining in part each of the at least one second channel through which the coolant flows into contact with a plurality of apertures in the at least one second channel within a plurality of sixth laminates with the at least one aperture of the at least one second channel in the at least one fifth laminate and the plurality of apertures in the plurality of sixth laminates forming jets of fluid which impinge upon a heat conductive surface of another laminate.

20. A heat exchanger in accordance with claim 1 wherein:

the heated fluid is a refrigerant within a vapor cycle cooling system of an airframe; and the coolant flows from the heat exchanger in a direction opposite to a direction the refrigerant flows from the heat exchanger.

* * * * *